US007008129B2

(12) United States Patent
McNally et al.

(10) Patent No.: US 7,008,129 B2
(45) Date of Patent: Mar. 7, 2006

(54) CAPACITIVE MAT CONTROL

(75) Inventors: Stephen McNally, Vancouver, WA (US); Robert M. Yraceburu, Camas, WA (US); David E. Smith, Vancouver, WA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 22 days.

(21) Appl. No.: 10/824,134

(22) Filed: Apr. 14, 2004

(65) Prior Publication Data

US 2005/0231577 A1 Oct. 20, 2005

(51) Int. Cl.

| | |
|---|---|
| ***B41J 11/02*** | (2006.01) |
| ***B41J 11/04*** | (2006.01) |
| ***B41J 11/057*** | (2006.01) |
| ***B41J 13/00*** | (2006.01) |

(52) U.S. Cl. ..... 400/578; 347/104

(58) Field of Classification Search ..... 361/234; 279/128

See application file for complete search history.

(56) References Cited

U.S. PATENT DOCUMENTS

| | | | | |
|---|---|---|---|---|
| 3,359,469 | A | 12/1967 | Levy et al. | |
| 3,448,356 | A | 6/1969 | Testone | |
| 3,571,678 | A | 3/1971 | Sezako et al. | |
| 3,851,962 | A | 12/1974 | Van Vloten | |
| 5,003,325 | A | 3/1991 | Bibl | |
| 5,877,790 | A | 3/1999 | Hagiwara et al. | |
| 5,975,683 | A | 11/1999 | Smith et al. | |
| 6,079,814 | A | 6/2000 | Lean et al. | |
| 6,419,411 | B1 * | 7/2002 | Tanno | 400/635 |
| 6,508,540 | B1 | 1/2003 | Lean et al. | |

FOREIGN PATENT DOCUMENTS

| | | | |
|---|---|---|---|
| JP | 03005176 A | * | 1/1991 |
| JP | 03051237 A | * | 3/1991 |
| JP | 06206326 A | * | 7/1994 |
| JP | 10087102 A | * | 4/1998 |
| JP | 2000191172 A | * | 7/2000 |
| JP | 2000246981 A | * | 9/2000 |

OTHER PUBLICATIONS

Machine translation of JP 2000-246981 to Watanabe from Japanese Patent Office website.*
Machine translation of JP 10-087102 to Sato et al. from Japanese Patent Office website.*
Machine translation of JP 06-206326 to Nomura et al. from Japapese Patent Office website.*
McNally et al., U.S. Appl. No. 10/629,414, filed Jul 29, 2003.

* cited by examiner

*Primary Examiner*—Daniel J. Colilia
(74) *Attorney, Agent, or Firm*—Robert D. Wasson

(57) ABSTRACT

A method is disclosed for controlling a capacitive mat by energizing first and second nodes of the capacitive mat with opposite polarity, forming an image on the media, and reversing the polarity of the first and second nodes.

23 Claims, 5 Drawing Sheets

CAPACITIVE MAT CONTROL

BACKGROUND

In general, many imaging devices temporarily secure media in a relationship with a print engine during image formation. One kind of device used to temporarily secure sheet media is a capacitive mat. A capacitive mat uses electrostatic charges to temporarily secure the media to a platen surface.

Some capacitive mats tend to develop a decrease in hold down force over time. This phenomenon may be caused by the building of residual electrostatic charge in nonconductive material in the mat over the course of operative time. This residual electrostatic charge tends to reduce the efficiency or holding force of the capacitive mat with respect to the supported media. Such loss of holding force can lead to movement of the media or poor registration of the media supported by the capacitive mat during operation, which may result in impaired imaging quality, media jams, or both.

DETAILED DESCRIPTION

Figure 1:
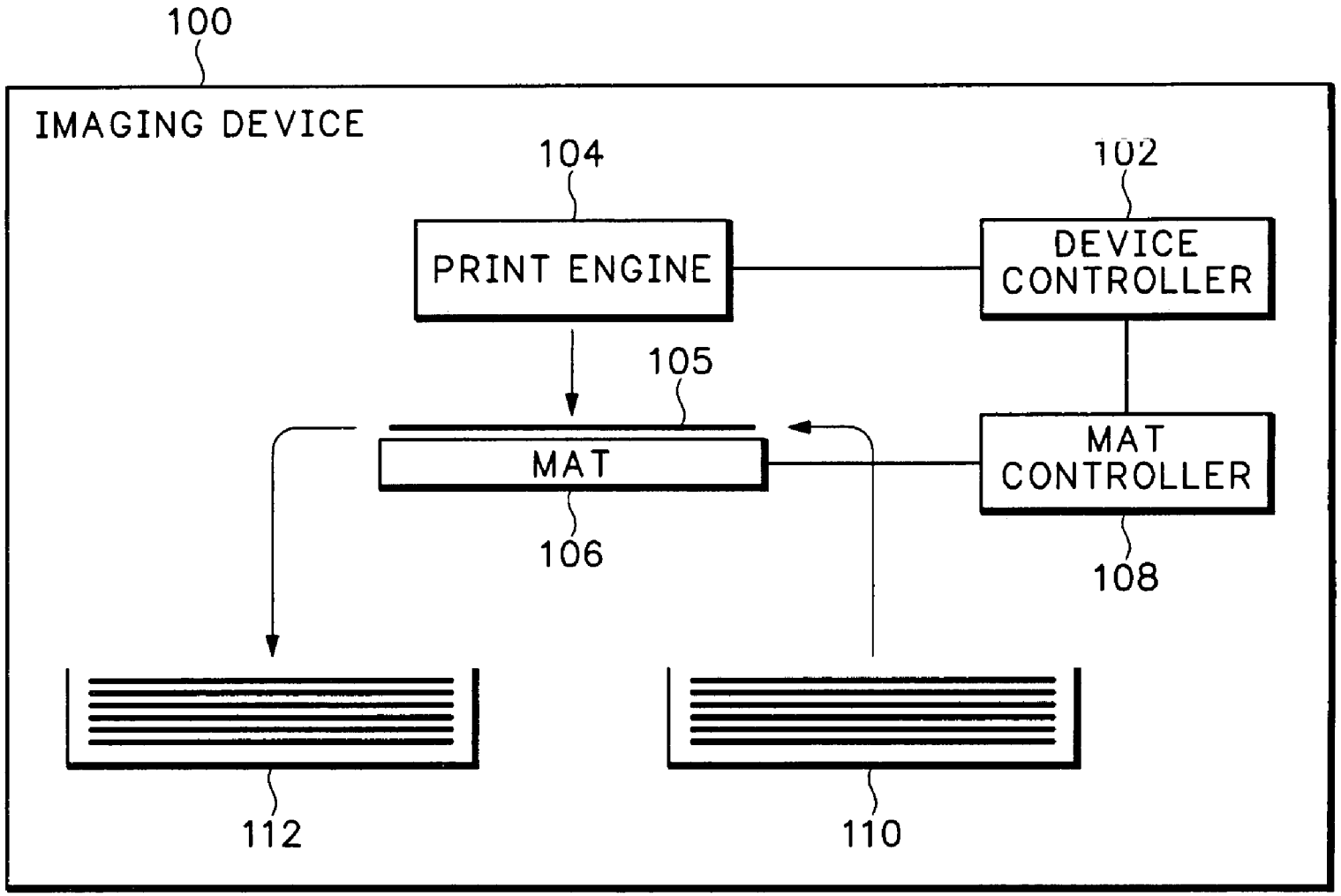
FIG. 1 is a schematic diagram depicting an imaging device in accordance with an example embodiment.

FIG. 1 schematically illustrates an imaging device 100, such as a printer, in accordance with an example embodiment. The imaging apparatus 100 includes device controller 102. The controller 102 can comprise, for example, a controller suitable for controlling operation of the imaging device 100. As such, the controller 102 can include, for example: a microprocessor or microcontroller; a solid-state memory or other computer-accessible storage media; a state machine; digital, analog, and/or hybrid electronic circuitry; sensing instrumentation; or other suitable device. Various embodiments of the controller 102 can be used in correspondence with differing embodiments of the imaging apparatus 100.

The imaging apparatus 100 also includes a print engine 104. The print engine 104 is generally coupled in controlled relationship with the controller 102. The print engine 104 may comprise any imaging engine suitable for selectively forming images on sheet media 105 under the control of the controller 102. For example, the print engine 104 can comprise an inkjet imaging engine. Other suitable imaging engines, such as an electrophotographic imaging engine, can also be used.

The device 100 also includes a capacitive mat 106. In some embodiments, multiple capacitive mats 106 may be employed. The capacitive mat 106 of FIG. 1 may comprise a platen generally configured to controllably support a sheet media 105 in substantially registered orientation with the print engine 104 (or other suitable elements of the imaging apparatus 100, not shown) during normal operation. The capacitive mat 106 is configured to provide such support of the sheet media 106 by way of electrical (i.e., capacitive, or electrostatic) attraction under the control of a mat controller 108.

In some embodiments, the mat controller 108 includes electronic circuitry suitable for electrically coupling the capacitive mat 106 to a source or sources of electrical energy. Pursuant to one example embodiment, the controller 108 electrically couples sets of conductive electrodes at the mat 106 with opposite polarities and selectively reverses the polarities of the sets of conductive electrodes, such as in response to one or more control signals from the device controller 102. Hence, in some embodiments, the mat controller 108 functions as a switching device to selectively couple electrical nodes of the mat 106 to voltages of different polarity.

In particular embodiments, the mat controller 108 may be configured to reverse polarity of the mat electrodes under the influence of the controller 102 and in accordance with the methods described herein. Thus, the mat controller 108 can include, for example: digital, analog and/or hybrid electronic circuitry; signal amplifying circuitry; electrical switching devices; a microprocessor or microcontroller; etc.; or any combination of these or other suitable circuit elements. Varying embodiments of the mat controller 108 can be used. It will also be appreciated that the functionality of the mat controller 108 can be provided by components within the controller 102, described above. Hence, the components of the mat controller 108 and those of the device controller 102 may be separately housed as shown in FIG. 1, or may be commonly housed or otherwise integrated.

The device 100 may also include a media input tray 110 for storing sheets of media. Media handling input devices (not shown) may be used to advance media from the input tray 110 to the mat 106. The device 100 may also include a media output tray 112. Media handling output devices (not shown) may be used to advance media from the mat 106 to the output tray 112. The device 100 may optionally also include optical scanning mechanisms (not shown) in some embodiments.

According to some embodiments, the device 100 operates by charging electrodes of the mat 106 with opposite polarity. A sheet of media 105 from the input tray 110 is loaded on the mat 106 into a print zone so that the print engine 104 may at least partially form an image thereon. The media 105 is then advanced out of the print zone and removed from the mat 106. In some embodiments, the electrodes of the mat 106 are temporarily de-energized during the removal of the media 105 from the mat 106. The mat controller 108 then reverses the charges the electrodes of the mat 106 with a reversed polarity before another sheet of media is loaded on the mat 106.

Figure 2:
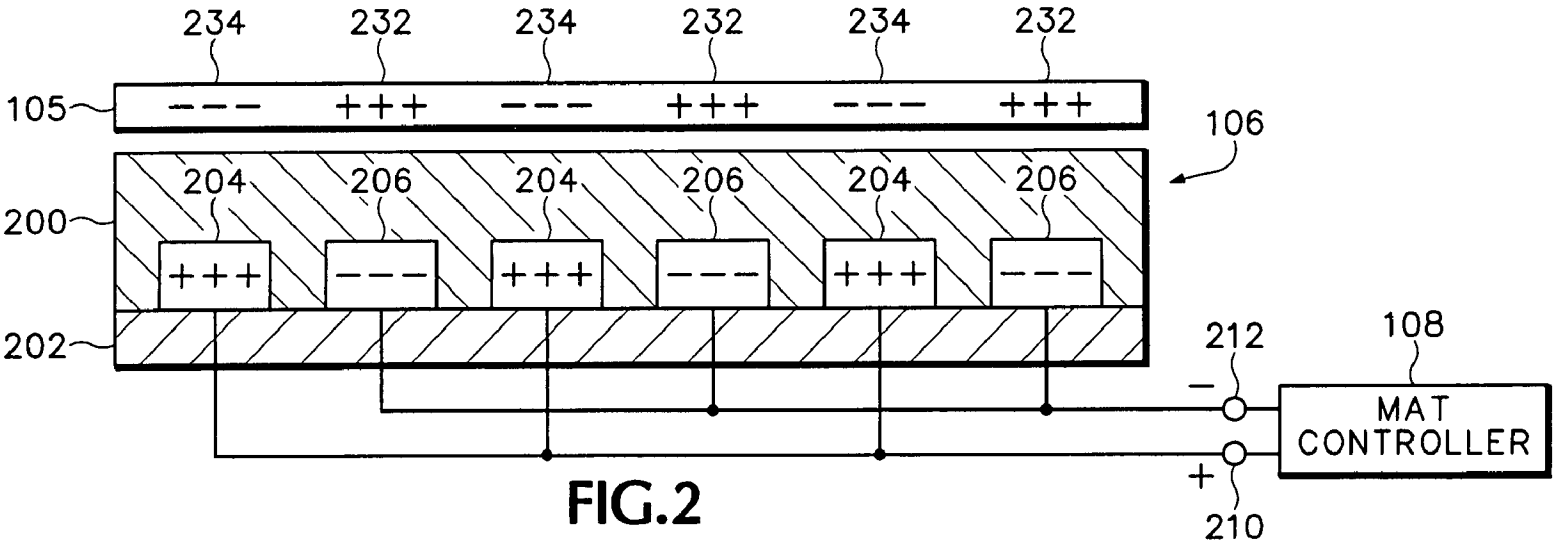
FIG. 2 is a sectional view depicting a capacitive mat with electrodes in a polarity configuration according to an example embodiment.

FIG. 2 illustrates a side elevation sectional view that depicts an example embodiment of mat 106. As illustrated, the mat 106 includes a non-conductive substrate 202. The substrate 202 supports first conductors 204 and second conductors 206. The conductors are arranged on the substrate 202 so as to generally define an inter-digitated, conductive grid or matrix on the substrate 202. In this configuration, pairs of first conductors 204 are separated by a second conductor 206. Likewise, pairs of second conductors 206 are separated by a first conductor 204. The first conductors 204 may comprise electrodes electrically coupled to a first terminal 210 of the mat controller 108. Similarly, the second conductors 206 may comprise electrodes electrically coupled to a second terminal 212 of the mat controller 108. The first conductors 204 are electrically connected so as to form a first electrical node. Likewise, the second conductors 206 are electrically connected so as to form a second electrical node.

The capacitive mat 106 also includes a non-conductive, dielectric cover material 200 that overlies and substantially encapsulates the conductors 204, 206. In this way, the conductors 204, 206 are substantially isolated against direct contact with each other and entities outside of the capacitive mat 106 (with the exception of electrical coupling to the mat controller 108).

In the configuration shown in FIG. 2, the terminal 210 is positively charged and the terminal 212 is negatively charged. As such, the first conductors 204, or the first electrical node, are positively charged and the second conductors 206, or the second electrical node, are negatively charged. Hence, in this configuration, the first and the second conductors 204, 206 are charged with opposite polarity.

The electric field corresponding to the energized conductors 204, 206 causes a corresponding migration of electrical charge within the media 105, such that regions of positive charge 232 generally accumulate within the media 105 over each of the negatively charged conductors 206, while regions of negative charge 234 generally accumulate over each of the positively charged conductors 204. As a result, a capacitive or electrostatic hold-down or 'tacking' force is exerted on the sheet media 105, which serves to support the sheet media 105 in a substantially registered orientation with respect to the capacitive mat 106.

Eventually, the need to hold-down or register the sheet media 105 with the respect to the capacitive mat 106 ends. At such time, the mat controller 108 may (but not necessarily) de-energize the conductors 204, 206, resulting in the substantial release of the sheet media 105.

Figure 3:
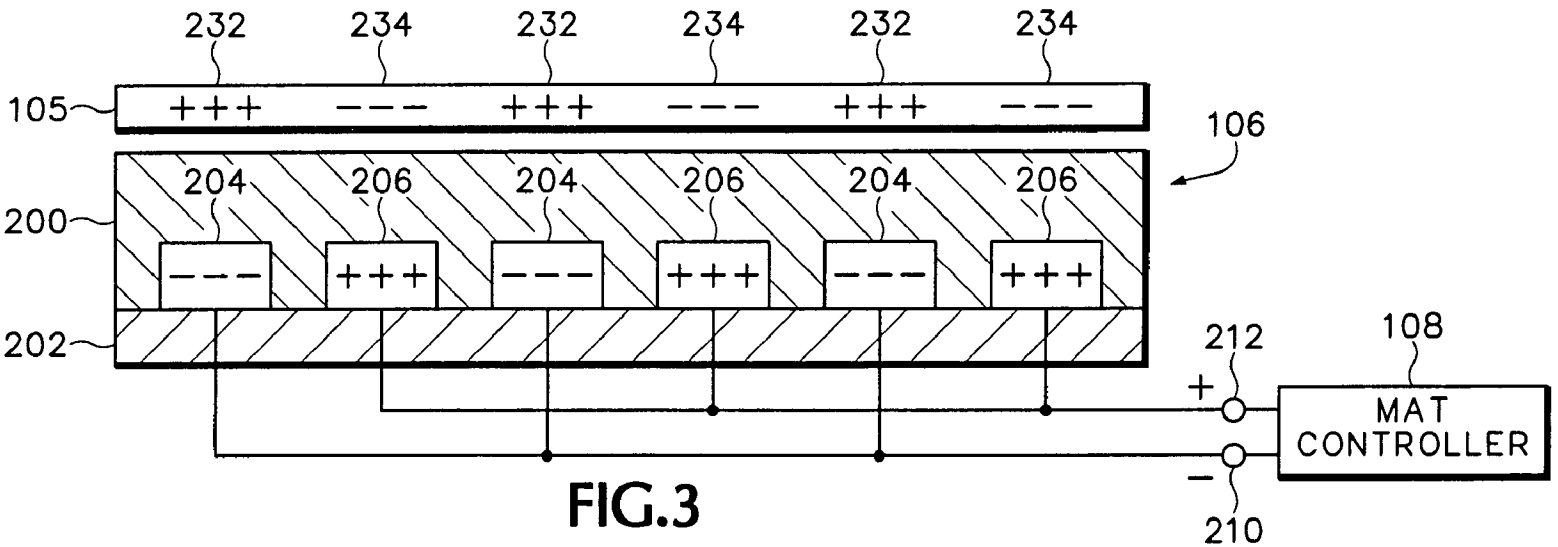
FIG. 3 is a sectional view depicting the capacitive mat of FIG. 2 with electrodes in an opposite polarity configuration according to an example embodiment.

FIG. 3 illustrates the mat 106 with the polarity of the terminals 210 and 212 reversed. In this configuration, the terminal 210 is negatively charged and the terminal 212 is positively charged. Hence, in this configuration, the first conductors 204 are negatively charged and the second conductors 206 are positively charged. Consequently, in this configuration, the regions of positive charge 232 are now over the first conductors 204 and the regions of negative charge 234 are over the second conductors 206.

In accordance with some embodiments, switching the polarity of the first and second conductors 204, 206 addresses and at least partially alleviates the reduction in hold down force due to polarization of the material 200. Further, in some embodiments, switching the polarity of the first and second conductors 204, 206 helps restore the hold down force of the capacitive mat 106.

Figure 4:
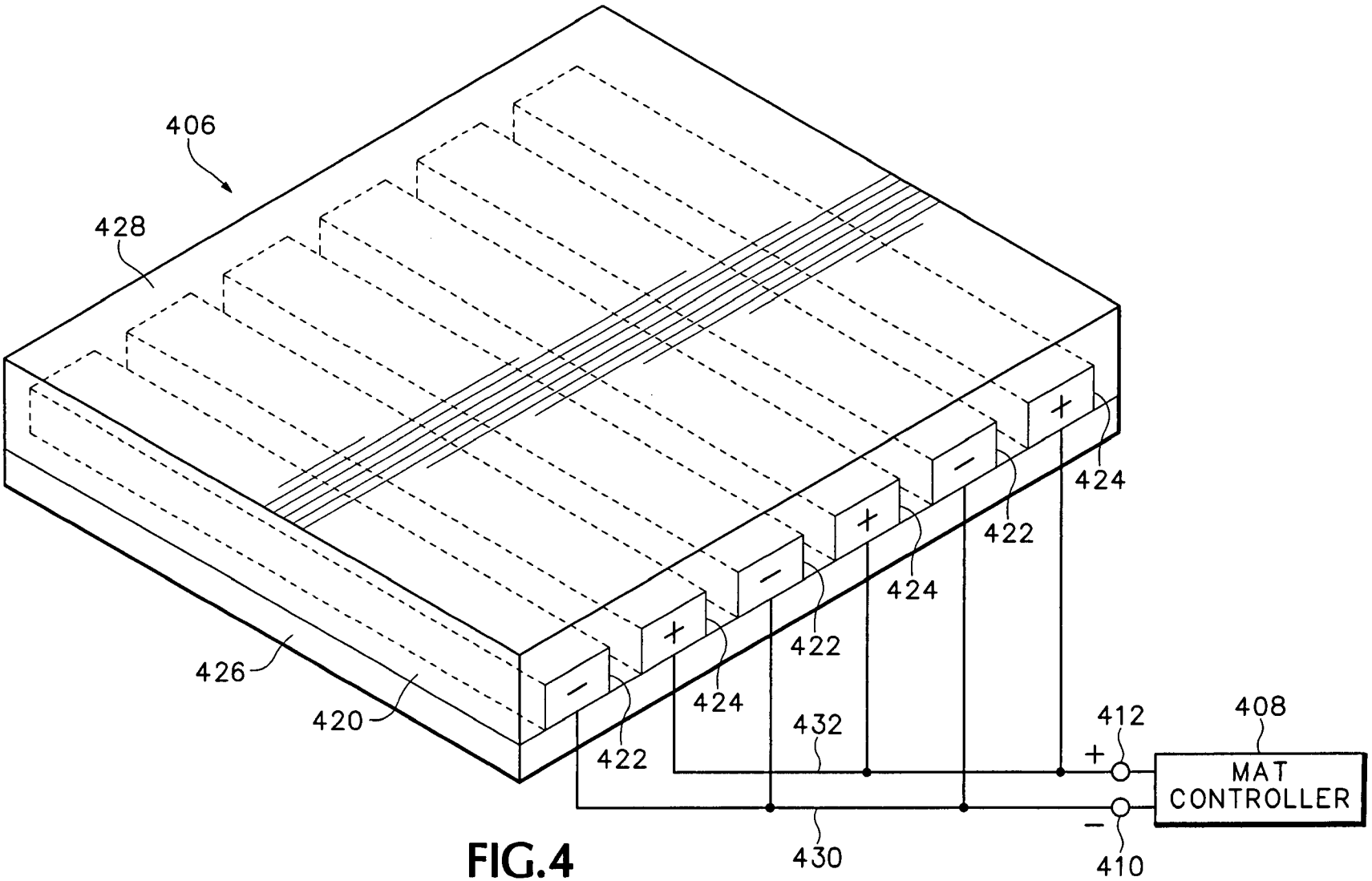
FIG. 4 is a perspective view depicting a capacitive mat in accordance with an example embodiment.

FIG. 4 is a perspective view depicting a capacitive mat 406 in accordance with an example embodiment. The capacitive mat 406 can be used as the capacitive mat 106 of FIG. 1. The capacitive mat 406 includes a non-conductive (i.e., dielectric) substrate 420. The substrate 420 can be formed from any suitable dielectric material, such as, for example, plastic, glass, silicon dioxide, etc. Other materials can also be used to form the substrate 420.

The capacitive mat 406 also includes first conductors 422, and second conductors 424. Each of the first and second conductors 422, 424 can be formed from any suitable electrically conductive material. Non-limiting examples of such electrically conductive material include copper, silver, conductively doped semiconductor, etc. Other suitable electrically conductive materials can also be used.

As depicted in FIG. 4, the first conductors 422 are arranged in alternating, spaced, substantially parallel placement with the second conductors 424, such that a grid or matrix is supported by the substrate 420. Each of the first conductors 422 is electrically coupled to one another so as to define a first node 430. Similarly, each of the second conductors 424 is electrically coupled to one another to define a single second node 432. Each of the first conductors 422 and the second conductors 424 extends substantially across a widthwise dimension of the capacitive mat 406. Furthermore, the particular number, dimensions, and configuration of the first and second conductors 422, 424 can vary.

The capacitive mat 406 further includes a dielectric cover material 426. The dielectric cover material can be formed from any suitable electrically non-conductive material such as, for example, plastic, glass, silicon dioxide, etc. Other suitable materials can also be used to form the cover material 426. The cover material 426 is configured to cooperate with the substrate 420 such that the first and second conductors 422, 424 are substantially encapsulated and isolated against physical contact with entities outside of the capacitive mat 406, except for contact with the mat controller 408. The cover material 426 is further configured to define a substantially planar support surface 428.

The mat controller 408 is electrically coupled to the first node 430 at a first terminal 410 and is electrically coupled to the second node 432 of the capacitive mat 406, at a second terminal 412. The mat controller 408 can be configured, for example, in accordance with the, the mat controller 108. Thus, the mat controller 408 is generally configured to selectively energize the first and second nodes 430, 432 with opposite polarity in response to an appropriate input or signal. The mat controller 408 may also be configured to selectively reverse the polarity of the terminals 410, 412 to reverse the polarity of the first and second nodes 430, 432.

Typical operation of the capacitive mat 406 may be generally as described herein in regard to the capacitive mats 106, 506. In this way, the capacitive mat 406 is generally configured to controllably exert an electrostatic hold-down force on a sheet of media (not shown) so as to maintain such a sheet of media in supportive registration during imaging operations within an imaging apparatus and to selectively reverse the polarity of the charge to restore, or otherwise improve, the hold-down force.

Figure 5:
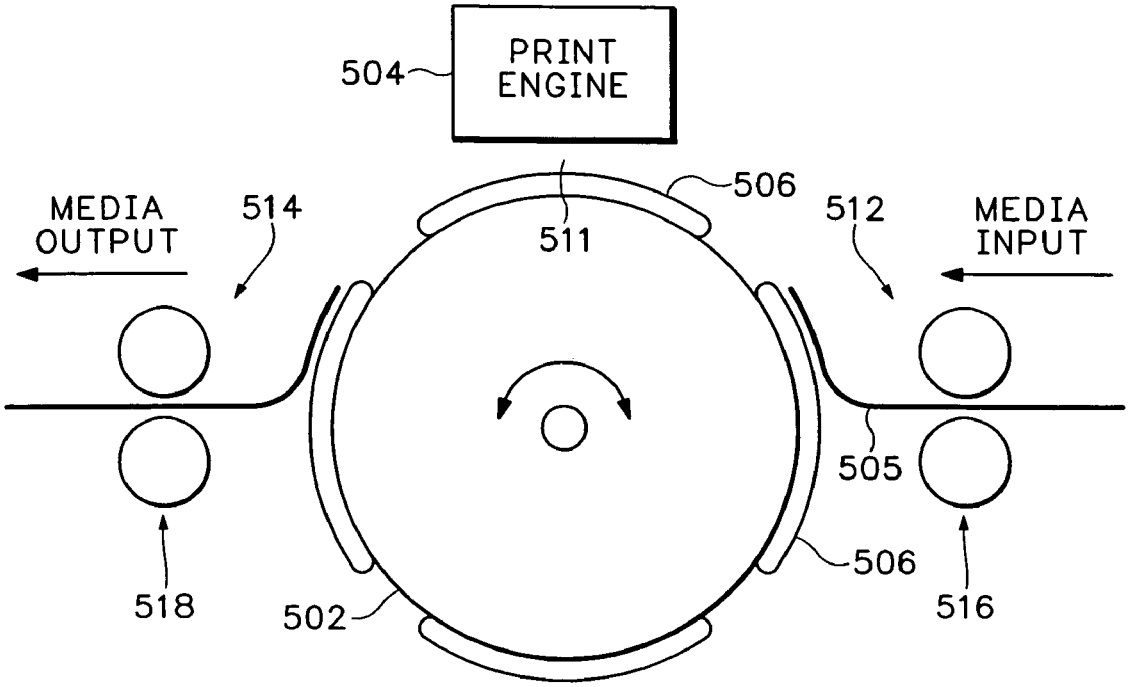
FIG. 5 is a schematic diagram of an imaging device in accordance with another example embodiment.

FIG. 5 is a schematic illustration of an imaging device 500 in accordance with an example embodiment. The device 500 includes drum 502 having multiple mats 506 disposed thereon. Each mat may be configured similar to the mats 106, 406 described above, for example. The mats 506, however, are shown as having a curved, or arcuate, shape that substantially conforms to the curvature of the drum 502. In some embodiments, the drum 502 may include a single mat 506.

The device 500 may also include an input path 512 and an output path 514. The input path 512 may include one or more rollers 516 for advancing media 505 from an input tray (not shown) to a mat 506. The output path 514 may include one or more rollers 518 for advancing media from a mat 506 to an output tray (not shown). The rollers 518, 516 are optional. A print engine 504, such as an inkjet, electrostatic, or other suitable print engine, is positioned adjacent to the drum 502 and is configured to at least partially form an image on media 505 when the media 505 is disposed within a print zone 511.

In accordance with one embodiment, in operation, the first and second nodes of the mat 506 are charged with opposite polarity before or as a sheet of media 505 is loaded onto the mat 506, such as through the rollers 516. Electrostatic forces resulting from the charged first and second nodes assist in maintaining the media 505 on the mat 506 as the drum 502 rotates. The drum 502 rotates to position the media 505 in the print zone 511 where the print engine 504 at least partially forms an image on the media 505. The drum 502 continues to rotate and advances the media 505 out of the print zone 511. At this point, the polarity of the first and second nodes of the mat 506 may be switched, or reversed, to substantially restore the strength of the electrostatic force holding the media 505 to the mat 506. With the polarity of the first and second nodes of the mat 506 reversed, the drum 502 may advance the media 505 through the print zone 511 a second time, either by reversing the direction of rotation of the drum 502 or by continuing in the same rotational direction.

In accordance with another embodiment, in operation, the first and second nodes of the mat 506 are charged with opposite polarity before or as the media 505 advances onto the mat 506. Electrostatic forces resulting from the charged first and second nodes assist in maintaining the media 505 on the mat 506 as the drum 502 rotates. The drum 502 rotates to position the media 505 in the print zone 511 where the print engine 504 at least partially forms an image on the media 505. The drum 502 continues to rotate and advances the media 505 out of the print zone 511. At this point, the first and second nodes may be de-energized or coupled to ground to substantially reduce the strength of the electrostatic force holding media 505 to the mat 506 and the media 505 is removed from the mat 506 and advanced along path 514 through the rollers 518 to a suitable output location, such as an output tray.

In some embodiments, the first and second nodes do not need to be de-energized to remove the media 505 from the mat 506. As the media 505 is removed from the mat 506, the media 505 is advanced along path 514 to a suitable output location, such as an output tray. After the media 505 has been removed from the mat 506, the first and second nodes are charged with a polarization opposite from the polarization of the mat 506 with the media 505 disposed thereon. In some embodiments, the first and second nodes are charged with a polarization opposite from the polarization of the mat 506 less than five (5) seconds before or as a new sheet of media is loaded onto the mat 506.

In still another embodiment, the polarization of the first and the second nodes may be reversed while the media 505 is within the print zone 511.

Figure 6:
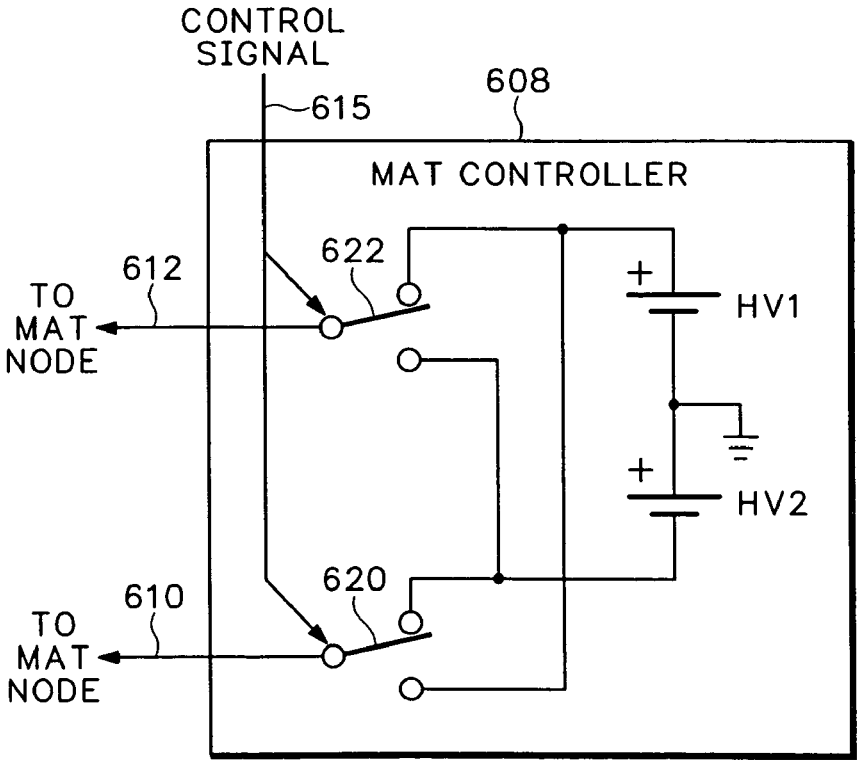
FIG. 6 illustrates details of a mat controller according to an example embodiment.

FIG. 6 illustrates a non-limiting example of a mat controller 608. As discussed above, the specific configuration or construction of the mat controller may vary. The mat controller 608 is shown as having terminals 610, 612 that may be coupled to corresponding nodes of a capacitive mat (not shown). Each of the terminals 610, 612 is electrically coupled to a corresponding switching device 620, 622 that operates under influence or control of one or more control signals 615. The switching devices 620, 622 may comprise relays or other suitable switching devices. The control signal(s) 615 may be generated at a device controller, such as the device controller 102 (FIG. 1).

The switching devices 620, 622 are illustrated in FIG. 6 as being in a first configuration, or state, so that the terminal 610 is electrically coupled to negative voltage HV2 and the terminal 612 is electrically coupled to positive voltage HV1. In another configuration (not shown), the switching devices 620, 622 are in an opposite state where they electrically couple the terminal 610 to the positive voltage HV1 and terminal 612 to the negative voltage HV2. Accordingly, under influence of one or more control signals 615, the mat controller 608 may charge first and second nodes of a capacitive mat with opposite polarity and reverse the polarity of the first and second nodes.

Figure 7:
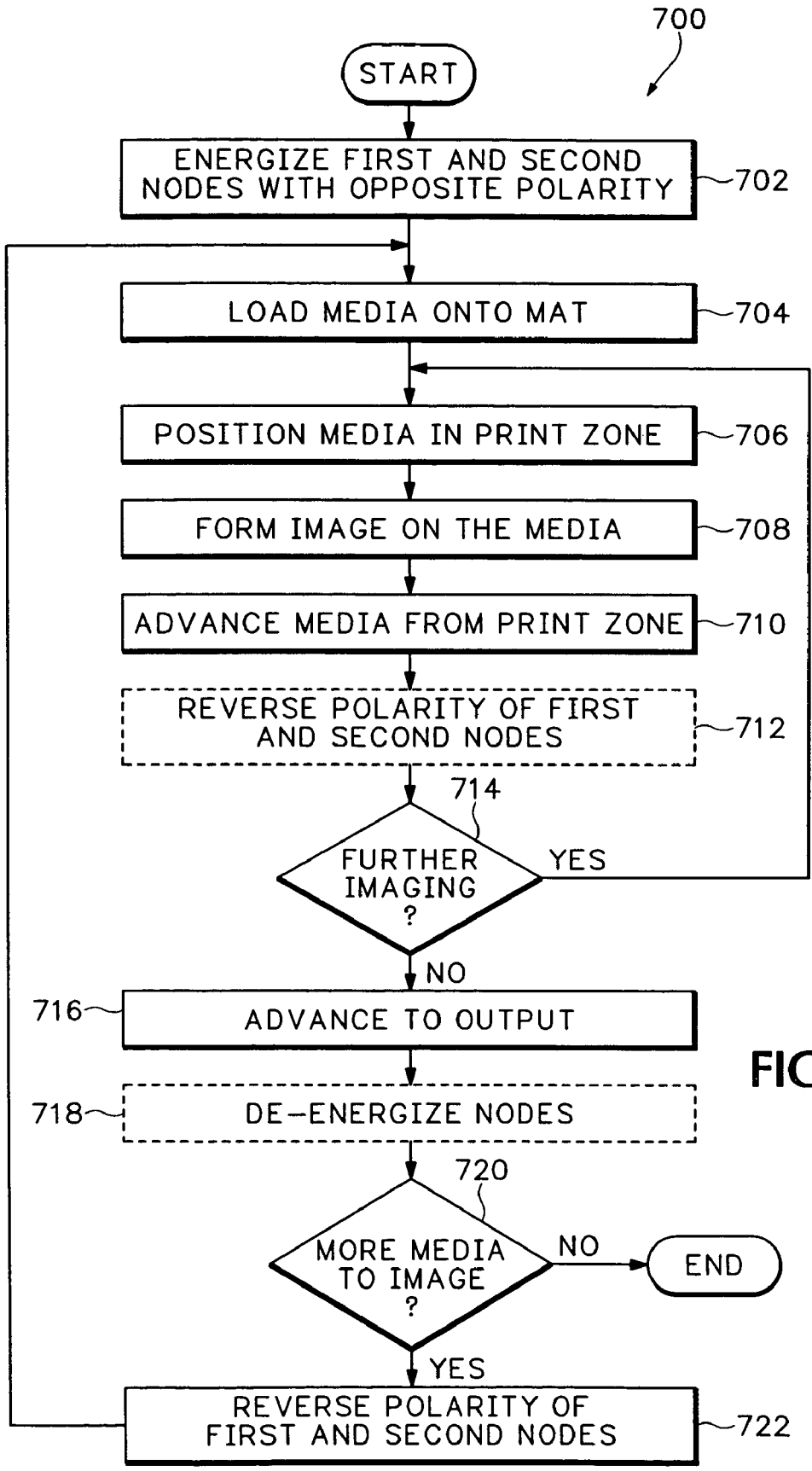
FIG. 7 is a flowchart depicting a method in accordance with an example embodiment.

FIG. 7 is a flowchart 700 illustrating a method in accordance with an example embodiment. Initially, the method begins by energizing 702 first and second nodes of a capacitive mat with opposite polarity. The media is loaded 704 onto the capacitive mat and positioned 706 within a print zone adjacent a print engine. In some embodiments, the energizing 702 occurs less than about five (5) seconds before the loading 704. The print engine at least partially forms 708 an image on the media within the print zone. The media is advanced 710 or otherwise removed from the print zone.

At block 712 the polarity of the first and second mat nodes may be reversed. The reversal of the polarity of the first and second mat nodes at block 712 is optional. Reversing the polarity of the first and second mat nodes may, in some embodiment, serve to refresh or to increase the hold down force on the media. In some embodiments, the operation of block 712 may precede that of block 710.

If, pursuant to block 714, the media is to be further imaged, then execution returns to positioning 706 the media in the print zone. If, pursuant to block 714, the media is not to be further imaged, execution proceeds to advancing 716 the media to a suitable output location, such as an output tray or the like. Optionally, the nodes may be de-energized 718 to facilitate removal of the media from the mat. In some embodiments, the nodes are not de-energized 718 to facilitate removal of the media from the mat at this point in the process. Execution then proceeds to 720.

If, pursuant to block 720, more media are to be imaged, execution proceeds to reversing 722 the polarity of the first and second mat nodes. Execution then proceeds to loading additional media 704 onto the capacitive mat. In some embodiments, the polarity of the capacitive mat is reversed 722 less than about five (5) seconds prior to or just as new media is loaded 704 onto the capacitive mat.

While the above methods and apparatus have been described in language more or less specific as to structural and methodical features, it is to be understood, however, that they are not limited to the specific features shown and described, since the means herein disclosed comprise example forms of putting the invention into effect. The methods and apparatus are, therefore, claimed in any of their forms or modifications within the proper scope of the appended claims appropriately interpreted in accordance with the doctrine of equivalents.

What is claimed is:

1. A method of controlling a capacitive mat, the method comprising:

energizing first and second nodes of the capacitive mat with opposite polarity;

loading first media onto the capacitive mat;

positioning the first media in a print zone;

forming an image on the first media;

reversing the polarity of the first and second nodes; and removing the first media from the print zone before the reversing the polarity of the first and second nodes.

2. The method of controlling a capacitive mat according to claim 1, further comprising returning the first media to the print zone after the reversing the polarity of the first and second nodes.

3. The method of controlling a capacitive mat according to claim 1, further comprising:

removing the first media from the capacitive mat;

loading second media onto the capacitive mat after the reversing of the polarity of the first and second nodes.

4. The method of controlling a capacitive mat according to claim 3, wherein the loading of me second media onto the capacitive mat occurs within five (5) seconds of the reversing the polarity of the first and second nodes.

5. A method of controlling a capacitive mat, the method comprising:

energizing first and second nodes of the capacitive mat with opposite polarity;

loading first media onto the capacitive mat;

positioning the first media in a print zone;

forming image on the first media;

reversing the polarity of the first and second nodes;

maintaining the polarities of the first and second nodes while the first media is disposed within the print zone.

6. A media handling apparatus, comprising:

a platen having first and second conductor arranged such that individual first conductor are separated by at least one individual second conductor;

a polarity control device configured to energize the first and second conductors with opposite polarity and to reverse the polarity of the first and second conductors according to a detected location of a sheet of print medium.

7. The media handing apparatus according to claim 6, further comprising a controller configured to provide me input signal to the polarity control device upon detection that the sheet of print medium has substantially exited a print zone.

8. The media handling apparatus according to claim 6, wherein the platen comprises a drum for supporting a print medium in an arced shape.

9. The media handling apparatus according to claim 6, further comprising a controller configured to provide the input signal to the polarity control device after detection that the sheet of print media has been substantially removed from the platen.

10. An image forming device, comprising:

a print engine;

platen disposed adjacent the print engine, the platen having first and second electrodes;

circuitry configured to charge the first and second electrodes with opposite polarity and to reverse the polarity of the first and second electrodes based on media location.

11. The image forming device of claim 10, further comprising a controller for controlling the print engine and the circuitry such that the circuitry reverses the polarity of the first and second electrodes after the media is removed from the platen.

12. The image forming device of claim 10, further comprising a controller for controlling the print engine and the circuitry such that the circuitry reverses the polarity of the first and second electrodes after the media is removed from the print zone.

13. The image forming apparatus of claim 10, further comprising:

an output tray;

a controller for controlling the print engine and the circuitry such that the circuitry reverses the polarity of the first and second electrodes after the media is deposited in the output tray.

14. The image forming device of claim 10, further comprising a controller for controlling the print engine and the circuitry such that the circuitry reverses the polarity of the first and second electrodes after the print engine has at least partially formed an image on the media.

15. The image forming device of claim 10, further comprising a controller for controlling the print engine and the circuitry such that the circuitry reverses the polarity of the first and second electrodes no more than five (5) seconds before loading media on the platen.

16. The image forming device of claim 10, wherein the print engine is an inkjet print engine.

17. The image forming device of claim 10, wherein the platen further comprises a rotating drum.

18. A device comprising:

a print engine for forming an image on media positioned in a print zone;

means for energizing first and second nodes of a capacitive mat with opposite polarity and reversing the polarity of the first and second nodes no more than five (5) seconds before loading media on the capacitive mat.

19. A method for controlling a capacitive mat, the method comprising:

energizing first and second nodes of the capacitive mat with opposite polarity;

forming an image on media positioned in a print zone;

reversing the polarity of the first and second nodes no more than five (5) seconds before loading media on the capacitive mat.

20. The method of claim 19, further comprising:

removing the media from the capacitive mat;

loading another piece of media onto the capacitive mat after the reversing of the polarity of the first and second nodes.

21. The method of claim 20, wherein the loading of the another piece of media onto the capacitive mat occurs within five (5) seconds of the reversing the polarity of the first and second nodes.

22. A method for controlling a capacitive mat, the method comprising:

energizing first and second nodes of the capacitive mat with opposite polarity;

forming an image on media positioned in a print zone;

reversing the polarity the first and second nodes returning the media to the print zone after the reversing tire polarity of the first and second nodes.

23. A method for controlling a capacitive mat, the method comprising:

energizing first and second nodes of the capacitive mat with opposite polarity;

loading first media onto the capacitive mat;

positioning the first media in a print zone;

forming a first image on the first media;

advancing the first media from the print zone;

reversing the polarity of the first and second nodes;

removing the first media from the capacitive mat before the reversing the polarity of the first and second nodes;

loading second media onto the capacitive mat after the reversing of the polarity of the first and second nodes within five (5) seconds of the reversing the polarity of the first and second nodes.

* * * * *

UNITED STATES PATENT AND TRADEMARK OFFICE

CERTIFICATE OF CORRECTION

PATENT NO. : 7,008,129 B2
APPLICATION NO. : 10/824134
DATED : March 7, 2006
INVENTOR(S) : Stephen McNally et al.

It is certified that error appears in the above-identified patent and that said Letters Patent is hereby corrected as shown below:

On the Title page, item (73), under "Assignee", in column 1, line 2, delete "LP.," and insert -- L.P., --, therefor.

In column 7, line 7, in Claim 4, delete "me" and insert -- the --, therefor.

In column 7, line 16, in Claim 5, after "forming" insert -- an --.

In column 7, line 21, in Claim 6, delete "conductor" and insert -- conductors --, therefor.

In column 7, line 22, in Claim 6, delete "conductor" and insert -- conductors --, therefor.

In column 7, line 29, in Claim 7, delete "handing" and insert -- handling --, therefor.

In column 7, line 30, in Claim 7, delete "me" and insert -- the --, therefor.

In column 7, line 44, in Claim 10, before "platen" insert -- a --.

In column 8, line 46, in Claim 22, after "polarity" insert -- of --.

In column 8, line 47, in Claim 22, delete "tire" and insert -- the --, therefor.

Signed and Sealed this

Twentieth Day of July, 2010

David J. Kappos

David J. Kappos
*Director of the United States Patent and Trademark Office*